US006386515B1

(12) United States Patent
Sachtleben

(10) Patent No.: US 6,386,515 B1
(45) Date of Patent: May 14, 2002

(54) DEVICE TO INSTALL/REMOVE TRUCK CAP

(76) Inventor: Richard E. Sachtleben, 4633 Ridgebury Dr., Kettering, OH (US) 45440

( * ) Notice: Subject to any disclaimer, the term of this patent is extended or adjusted under 35 U.S.C. 154(b) by 0 days.

(21) Appl. No.: 09/833,759

(22) Filed: Apr. 13, 2001

Related U.S. Application Data

(60) Provisional application No. 60/202,916, filed on May 9, 2000.

(51) Int. Cl.[7] ..... B66D 1/36

(52) U.S. Cl. ..... 254/338; 254/334; 248/320; 248/328; 294/74; 414/626

(58) Field of Search ..... 254/334, 338, 254/343, 389; 248/320–323, 327–328; 414/626; 294/74

(56) References Cited

U.S. PATENT DOCUMENTS

| | | | | | |
|---|---|---|---|---|---|
| 433,022 | A | * | 7/1890 | Hensley | 254/338 |
| 973,572 | A | * | 10/1910 | Sims | 254/338 |
| 4,066,287 | A | * | 1/1978 | Rowley | 294/74 |
| 4,113,146 | A | * | 9/1978 | Williamson | 383/67 |
| 4,362,292 | A | * | 12/1982 | Rowan et al. | 254/336 |
| 4,600,177 | A | | 7/1986 | Fritz | |
| 4,706,939 | A | * | 11/1987 | Gagne | 254/338 |
| 4,767,099 | A | * | 8/1988 | Munks | 254/338 |
| 4,830,427 | A | * | 5/1989 | Fiocchi | 296/136 |
| 5,086,799 | A | | 2/1992 | Lumbleau | |
| 5,263,687 | A | | 11/1993 | Garbiso | |
| 5,282,706 | A | * | 2/1994 | Anthony et al. | 254/364 |
| 5,320,394 | A | * | 6/1994 | Urbank | 294/74 |
| 5,490,704 | A | | 2/1996 | Calnan | |
| 5,897,104 | A | | 4/1999 | Garbiso | |
| 5,984,275 | A | * | 11/1999 | Hoslett | 254/338 |
| 6,152,427 | A | * | 11/2000 | Hoslett | 254/338 |

* cited by examiner

*Primary Examiner*—Emmanuel M. Marcelo
(74) *Attorney, Agent, or Firm*—Richard C. Litman

(57) ABSTRACT

Apparatus for hoisting and suspending a pick-up truck cap adjacent the ceiling of a storage structure. The apparatus includes a slotted, aluminum beam and plural lifting straps. The lifting straps are removably secured at two positions on the beam. Plural storage cables are attached to the ceiling of the storage structure and extend around the truck cap. Each storage cable is adapted to be removably positioned on hooks disposed in the ceiling of the storage structure. A conventional worm gear winch and pulley system is provided for hoisting.

17 Claims, 5 Drawing Sheets

DEVICE TO INSTALL/REMOVE TRUCK CAP

CROSS-REFERENCE TO RELATED APPLICATION

This application claims the benefit of U.S. Provisional Patent Application Ser. No. 60/202,916, filed May 9, 2000.

BACKGROUND OF THE INVENTION

1. Field of the Invention

The present invention generally relates to hoists. More specifically the present invention is drawn to a hoist assembly for lifting and storing the cap structure of a pick-up truck.

2. Description of Related Art

There are many commercial devices available for lifting and storing a hard top of a convertible automobile. Examples of such devices are disclosed in U.S. Pat. Nos. 4,600,177 (Fritz), 5,263,687 (Garbiso), and 5,897,104 (Garbiso). Since an automobile hardtop is generally smaller and less cumbersome to maneuver than the cap of a pick-up truck, the above devices only require a single lifting position for the lifting strap.

U.S. Pat. No. 5,086,799 (Lumbleau) shows apparatus for selectively raising and lowering a cover for a vehicle. The apparatus of the instant patent is not sturdy enough to support the weight of a pick-up cap.

U.S. Pat. No. 5,490,704 (Calnan) shows a surveillance camper module that is transferable from one truck bed to another.

There is no detailed disclosure relating to the module lifting apparatus.

None of the above inventions and patents, taken either singly or in combination, is seen to disclose apparatus for lifting a pick-up truck cap as will subsequently be described and claimed in the instant invention.

SUMMARY OF THE INVENTION

The present invention is drawn to a hoist system for installing, removing and securely storing a cap from a pick-up truck or the like. The cap will be stored in a suspended position from the ceiling of a garage or similar structure.

The invention includes a hand winch, two pulleys, a lifting beam, and a lifting cable. At least two lifting straps are arranged for removable attachment at two positions on the lifting beam. Two storage cables are provided to further support the cap from the garage ceiling. As will be explained below, chain links are utilized for adjusting the lifting straps and storage cables to accommodate different cap sizes.

As contemplated, the present system will allow one person, without assistance, to hoist, store, and re-install a pick-up truck cap.

Accordingly, it is a principal object of the invention to provide a system for removing a pick-up truck cap.

It is another object of the invention to provide a system for storing a pick-up truck cap.

It is a further object of the invention to provide a system for installing, removing and storing a pick-up truck cap, which system may be operated by one person.

Still another object of the invention is to provide a system for removing and storing a pick-up truck cap, which system can be adjusted to accommodate different cap sizes.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
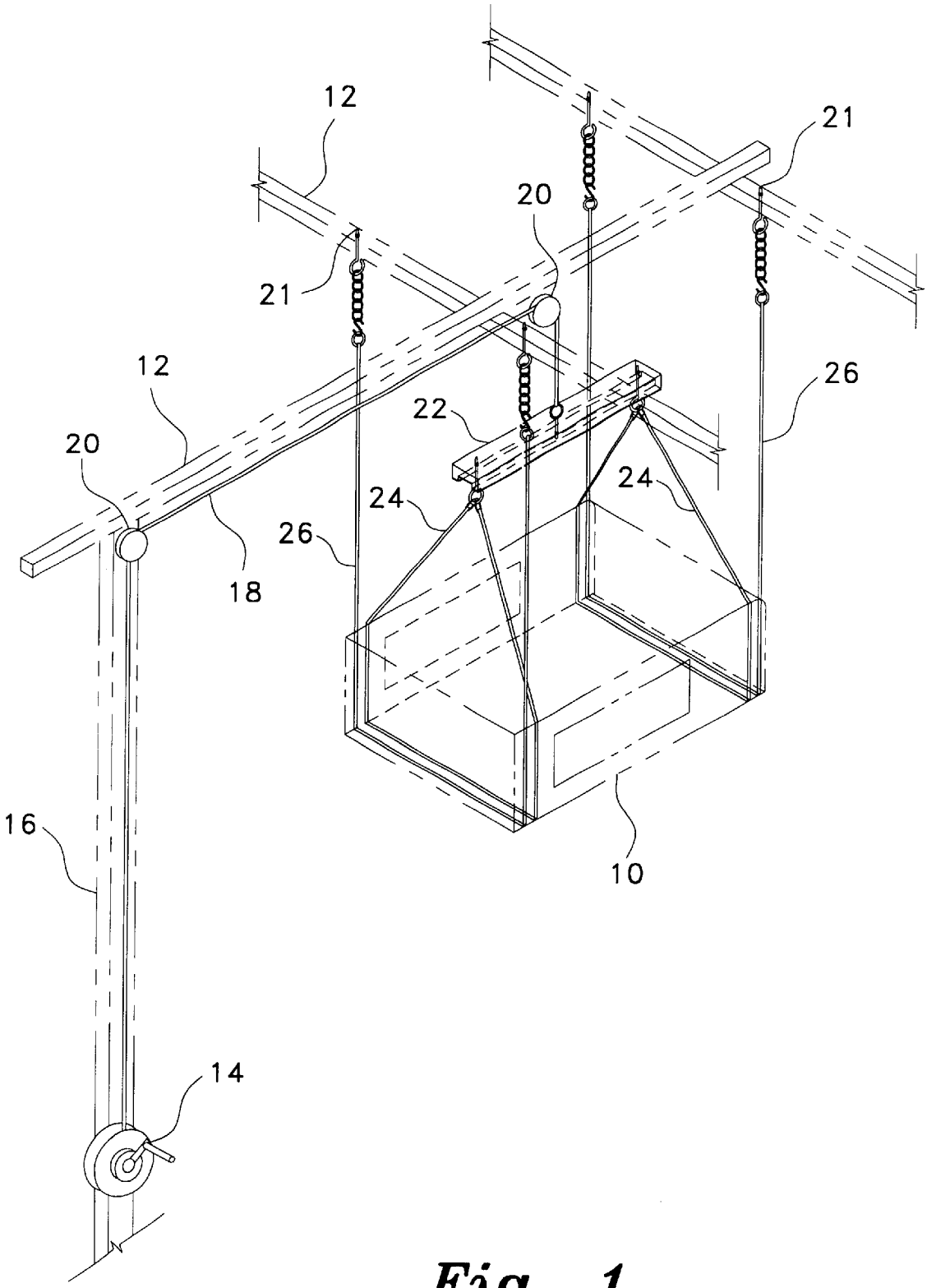
FIG. 1 is an environmental, perspective view of a pick-up truck hoisting and storing system according to the present invention.

Attention is directed to FIG. 1 which illustrates a pick-up truck cap (shown in phantom lines) at 10. Cap 10 is hoisted from the bed of a pick-up truck or the like (not shown) and is suspended from the ceiling joists 12 of a garage or similar structure. The cap is initially hoisted by means of a lifting cable 18 which passes through two pulleys 20. One end of cable 18 is attached to a lifting beam 22. A second end of cable 18 is fastened for winding on hand winch 14. Lifting cable 18 is fabricated from conventional wire rope. Winch 14 and pulleys 20 are conventional and are secured to a side wall stud 16 or ceiling joist 12 as is common in the art. Two lifting straps 24 each have ends removably attached to lifting beam 22. Straps 24 are attached at two positions on the lifting beam. Each strap 24 extends around the cap 10. Two storage cables 26 are also adapted to extend around cap 10 and are attached to a ceiling joist via ceiling hooks 21.

Figure 2:
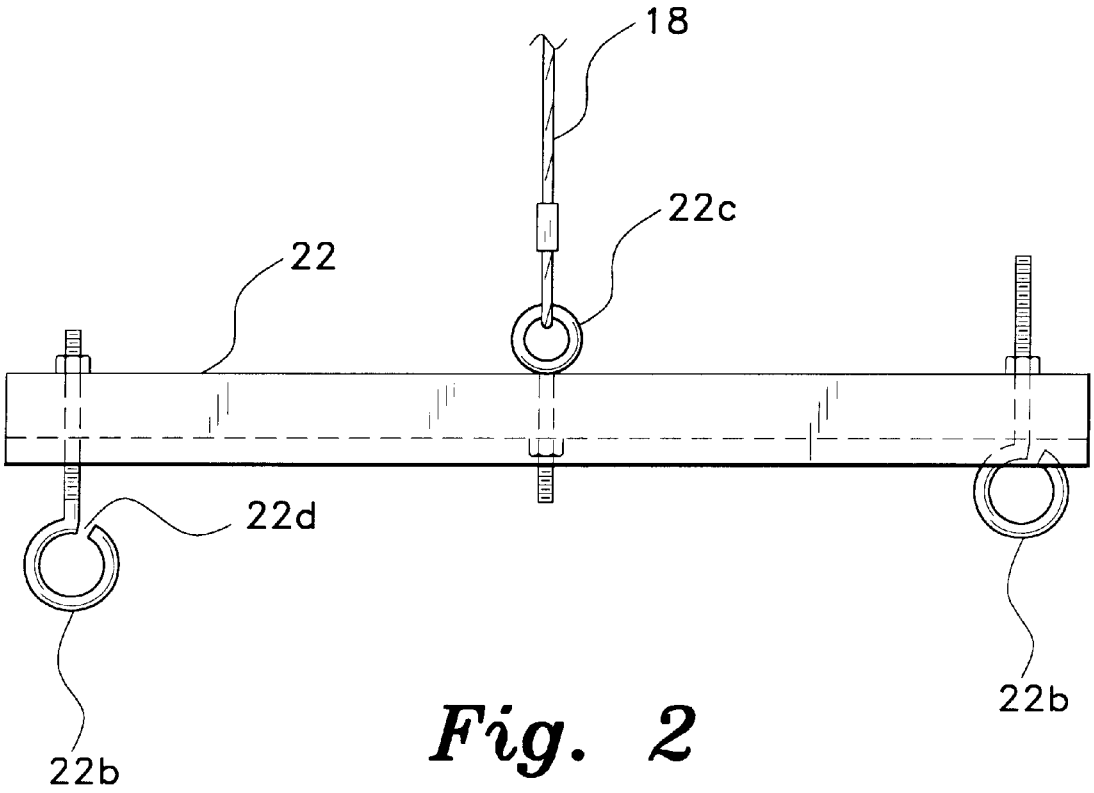
FIG. 2 is a front plan view of a lifting beam according to the present invention.
Figure 3:
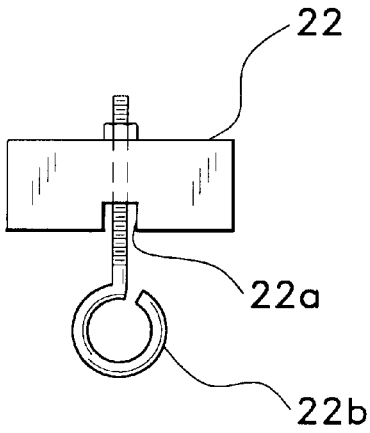
FIG. 3 is an end view of the lifting beam of FIG. 2 according to the present invention.

As best seen in FIGS. 2 and 3, lifting beam 22 is fabricated from an aluminum extrusion bar and has a slotted underside 22*a*. Equally spaced bores are formed in the beam to receive two eye bolts 22*b* and a central eye bolt 22*c*. Eye bolts 22*b* are modified so as to define a gap 22*d* therein. Eye bolts 22*b* may be adjusted to a lowered position (left end) for attaching or detaching lifting straps 24 via gaps 22*d*. Bolts 22*b* are adjusted in an upper position (right end) to prevent the lifting straps from disengagement with bolts 22*b* when the cap is to be hoisted. Lifting cable 18 is securely fastened to central bolt 22*c*.

Figure 4:
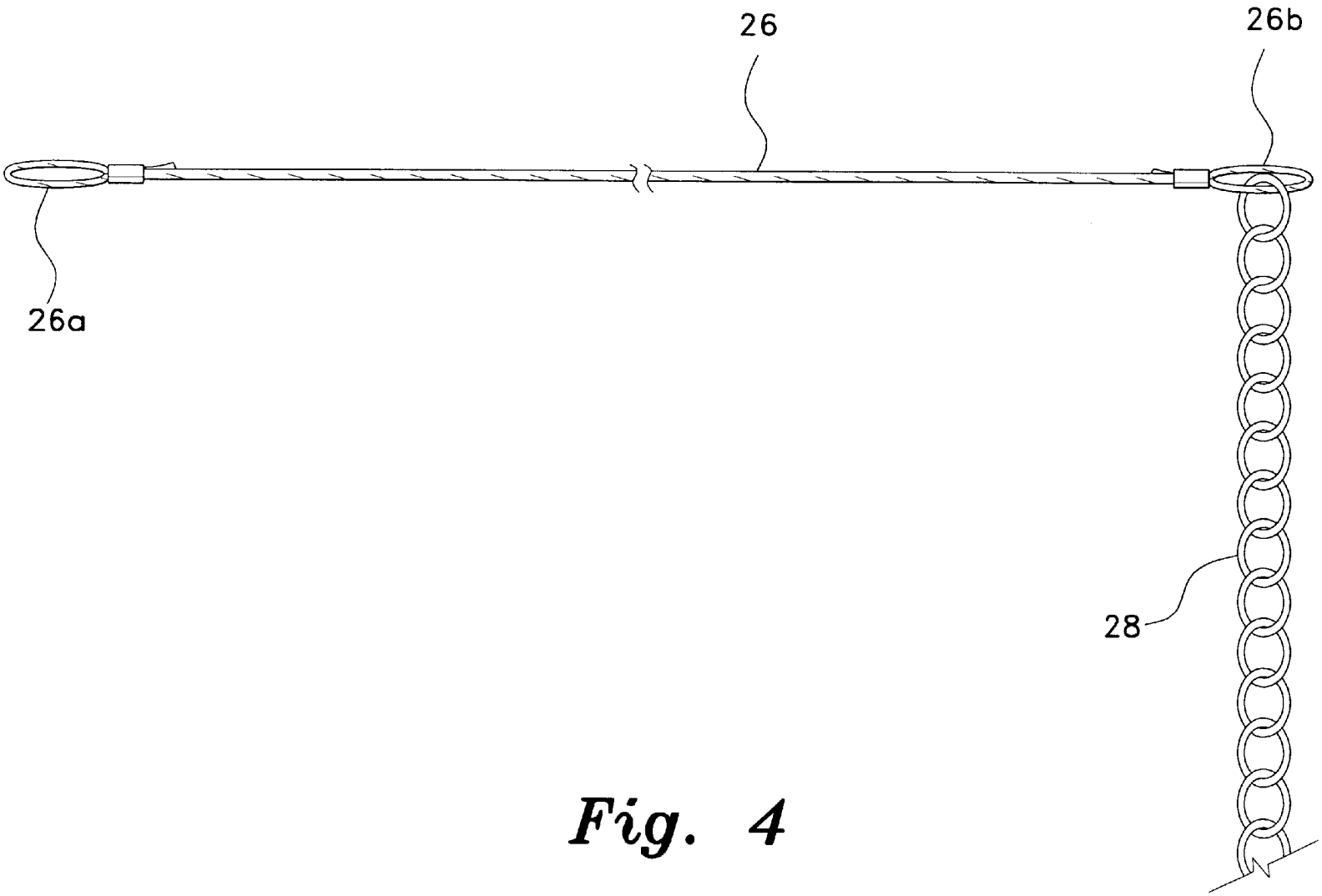
FIG. 4 is a plan view of a storage cable assembly according to the present invention.
Figure 5:
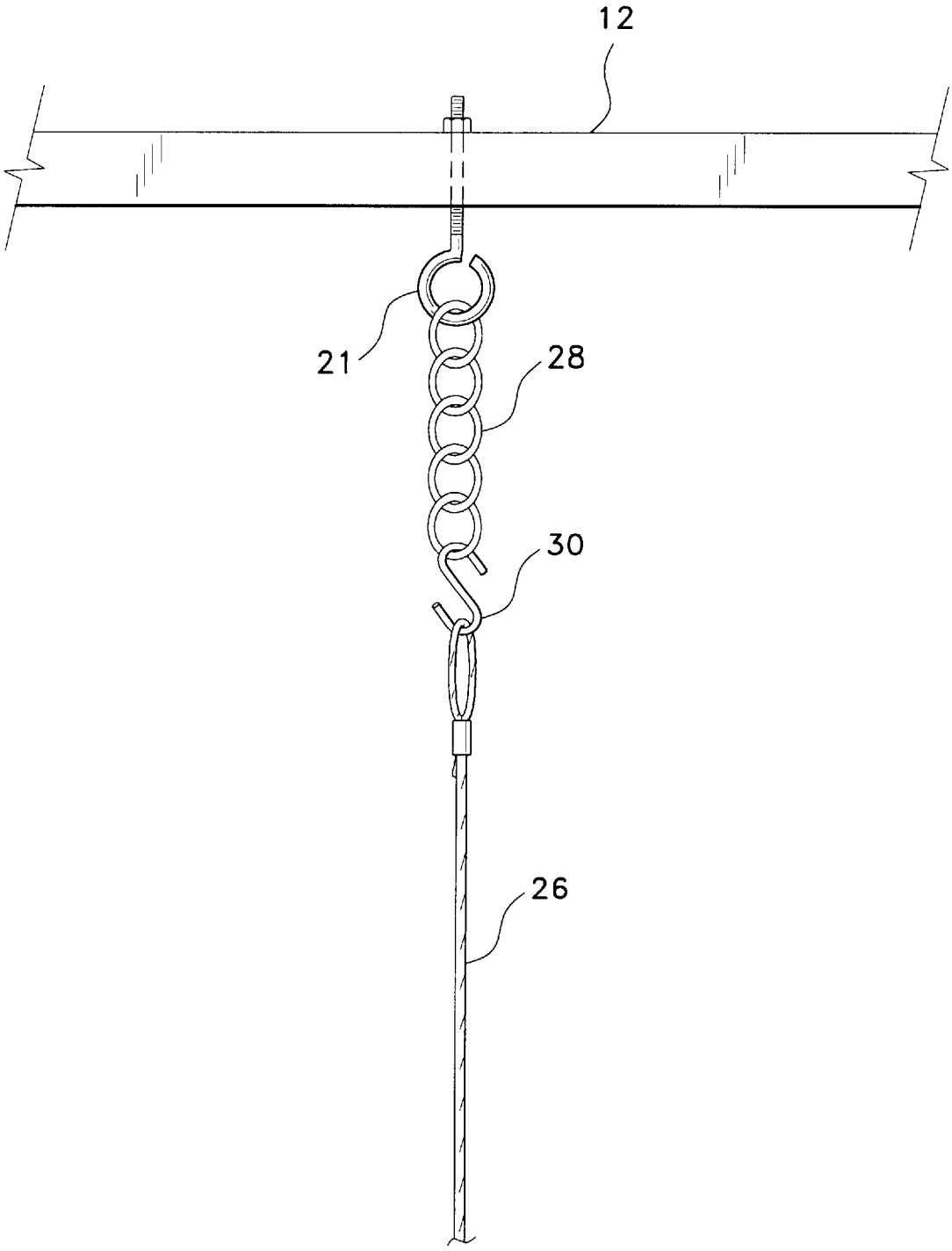
FIG. 5 is a plan view of a modification of the storage cable of FIG. 4 according to the present invention.

FIG. 4 illustrates the basic construction of the storage cable 26. Cable 26 is provided with looped first and second ends 26*a* and 26*b* for attachment to ceiling hooks 21. Although shown as looped, it is recognized that cable ends 26*a*, 26*b* may take on any convenient attachment design. End 26*b* incorporates a chain 28, which chain is adapted to be removably positioned on hook 21. Utilizing selected links in chain 28 will permit the system to be adjusted for storing different cap sizes. Storage cable 26 is constructed of one-eighth inch vinyl coated wire rope. FIG. 5 shows an alternate embodiment wherein the ends of cable 26 and chain 28 are interposed by an S-shaped hook 30. This arrangement makes for even more adjustment flexibility.

Figure 6:
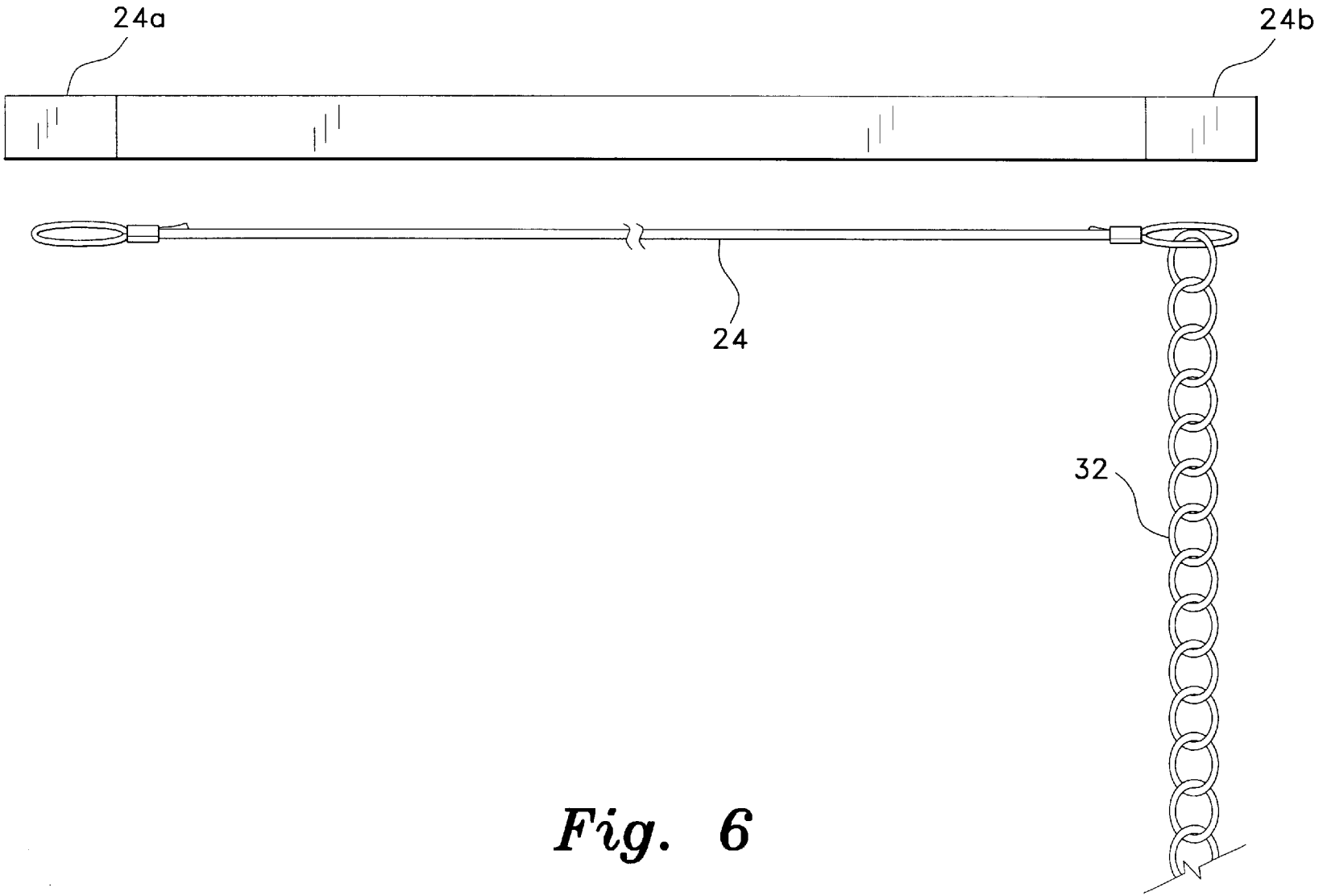
FIG. 6 is a plan view of a lifting strap according to the present invention.

Attention is now directed to FIG. 6 which shows a plan top view of a lifting strap 24. Strap 24 has ends 24*a*, 24*b* which are adapted to be removably attached to lifting beam 22. Although illustrated as a looped, ends 24*a*, 24*b* may take on any convenient and efficient attachment configuration. End 24*b* is optionally provided with a chain 32 adapted for insertion into eye bolt 22*b* of beam 22. As indicated above, chain 32 will allow for adjustment to accommodate different cap sizes. A multi-looped arrangement (not shown) may be used in lieu of chain 32 if desired. Lifting strap 24 is preferably fabricated of one inch wide nylon, however a one-eighth inch or three-sixteenth inch vinyl-coated wire rope may be effectively used.

To operate the invention a user must first disconnect cap 10 from the body of the pick-up truck. Straps 24 are extended around cap 10. Eye bolts 22*b* are adjusted to their lowered positions so that a selected link of each chain 32 and end 24*a* may be inserted onto a respective bolt by way of gaps 22*d*. Bolts 22*b* are then adjusted to their upper positions such that gaps 22*d* are now disposed in slot 22*a*. The user may now wind winch 14 to hoist cap 10 to a desired position adjacent the ceiling. If the cap is to be stored, selected links of chains 28 are positioned on ceiling hooks 21, allowing cables 26 to bolster storage support.

It is to be understood that the present invention is not limited to the sole embodiments described above, but encompasses any and all embodiments within the scope of the following claims.

I claim:

1. An apparatus for lifting a pick-up truck cap and suspending said cap from an overhead structure comprising:

a beam member, said beam member having a finite length, a planar upper surface and an undersurface;

a slot, said slot formed in said undersurface and extending the length of said beam;

a plurality of bores, said bores disposed through said beam member and equally spaced along the length of said beam;

a plurality of attachment devices, each of said plurality of attachment devices secured in a respective one of said plurality of bores;

first means for attaching said beam to said pick-up truck cap;

second means for selectively raising or lowering said beam member and attached pick-up truck cap; and third means for suspending said pick-up truck cap from the overhead structure.

2. The apparatus as recited in claim 1, wherein said beam member is fabricated from extruded aluminum.

3. The apparatus as recited in claim 2, wherein said attachment devices comprise at least three vertically-adjustable eye bolts.

4. The apparatus as recited in claim 3, wherein one of said vertically-adjustable eye bolts is secured to extend vertically upward from said upper planar surface.

5. The apparatus as recited in claim 4, wherein two of said vertically-adjustable eye bolts are secured to extend vertically downward from said slot in said undersurface.

6. The apparatus as recited in claim 5, wherein said first means includes at least one lifting strap, said lifting strap having a first end and a second end;

fastening means positioned on said first end and said second end for attaching said first end and second end to a respective one of said vertically-adjustable eye bolts which extend vertically downward from said slotted under surface.

7. The apparatus as recited in claim 6, wherein said fastening means comprises a loop formed in said first end and a loop formed in said second end.

8. The apparatus as recited in claim 7, wherein said fastening means further comprises:

a chain removably secured to said loop at said first end.

9. The apparatus as recited in claim 8, wherein there are at least two lifting straps.

10. The apparatus as recited in claim 9, wherein said at least two lifting straps are fabricated from nylon material.

11. The apparatus as recited in claim 10, wherein said second means for selectively raising and lowering comprises:

a lifting cable, said lifting cable having a first end and a second end, said first end of said lifting cable being attached to said beam member;

a winch;

said second end of said lifting cable being attached to said winch; and a pair of pulleys;

said lifting cable being threaded through said pair of pulleys.

12. The apparatus as recited in claim 11, wherein said first end of said lifting cable is attached to the eye bolt which extends vertically upward from said upper planar surface.

13. The apparatus as recited in claim 12, wherein said lifting cable is fabricated from wire rope.

14. The apparatus as recited in claim 13 wherein said third means for suspending comprises:

at least one storage cable, said storage cable having a looped first end and a looped second end.

15. The apparatus as recited in claim 14, including a chain, said chain removably disposed in said looped first end of said storage cable.

16. The apparatus as recited in claim 15, wherein said storage cable is fabricated from vinyl-coated wire rope.

17. The apparatus as recited in claim 16, wherein there are at least two storage cables.

* * * * *